US010227993B2

(12) United States Patent
Hayamitsu et al.

(10) Patent No.: US 10,227,993 B2
(45) Date of Patent: Mar. 12, 2019

(54) BLOWER APPARATUS AND VACUUM CLEANER

(71) Applicant: Nidec Corporation, Kyoto (JP)

(72) Inventors: Ryosuke Hayamitsu, Kyoto (JP); Jumpei Kitamura, Kyoto (JP)

(73) Assignee: Nidec Corporation, Kyoto (JP)

( * ) Notice: Subject to any disclaimer, the term of this patent is extended or adjusted under 35 U.S.C. 154(b) by 201 days.

(21) Appl. No.: 15/522,974

(22) PCT Filed: Oct. 30, 2015

(86) PCT No.: PCT/JP2015/080686
§ 371 (c)(1),
(2) Date: Apr. 28, 2017

(87) PCT Pub. No.: WO2016/068280
PCT Pub. Date: May 6, 2016

(65) Prior Publication Data

US 2017/0314573 A1 Nov. 2, 2017

(30) Foreign Application Priority Data

Oct. 30, 2014 (JP) ..... 2014-220914

(51) Int. Cl.
*F04D 29/44* (2006.01)
*F04D 29/28* (2006.01)
(Continued)

(52) U.S. Cl.
CPC ..... *F04D 29/444* (2013.01); *A47L 5/28* (2013.01); *F04D 17/16* (2013.01); *F04D 25/06* (2013.01); *F04D 29/281* (2013.01); *F04D 29/441* (2013.01)

(58) Field of Classification Search
CPC .... F04D 29/444; F04D 29/281; F04D 29/441; F04D 17/16; F04D 25/06; A47L 5/28
See application file for complete search history.

(56) References Cited

U.S. PATENT DOCUMENTS 4,057,370 A * 11/1977 Numata ..... F04D 25/082 415/119
4,767,285 A * 8/1988 Jyoraku ..... F04D 25/06 415/119
(Continued)

FOREIGN PATENT DOCUMENTS

DE 196 26 896 A1 1/1998
JP 09-004592 A 1/1997
(Continued)

OTHER PUBLICATIONS

Hayamitsu, R. et al.; "Blower Apparatus and Vacuum Cleaner"; U.S. Appl. No. 15/522,953, filed Apr. 28, 2017.
(Continued)

*Primary Examiner* — Dung Van Nguyen
(74) *Attorney, Agent, or Firm* — Keating & Bennett, LLP

(57) ABSTRACT

A blower apparatus includes a motor portion having a central axis extending in a vertical direction; an impeller arranged above the motor portion, joined to a rotating portion of the motor portion, and arranged to rotate to send a gas from above radially outward; an impeller cover portion including an inner surface arranged to cover an outer circumference of the impeller and an upper side of an outer edge portion of the impeller, and further including an air inlet defined in a center thereof; a body cover portion joined to the impeller cover portion, arranged to cover an outer circumference of the motor portion, and arranged to define a tubular space between the body cover portion and a housing tubular portion defining an outer surface of the motor portion and extending in the vertical direction to assume a tubular shape; and a plurality of guide vanes arranged in a circumferential direction in the tubular space, and each of which is arranged to extend in a radial direction between an inner surface of the body cover portion and the housing tubular portion. Each of the guide vanes includes a
(Continued)

guide vane upper portion arranged on an upper side, and a guide vane lower portion arranged on a lower side of the guide vane upper portion. The guide vane upper portion is inclined to a greater degree with respect to an axial direction than the guide vane lower portion. A lower end of the guide vane is arranged forward of an upper end of the guide vane with respect to a rotation direction of the impeller. The lower end of at least one of the guide vanes is arranged above a lower end of the housing tubular portion.

18 Claims, 8 Drawing Sheets

(51) Int. Cl.

| | |
|---|---|
| ***A47L 5/28*** | (2006.01) |
| ***F04D 17/16*** | (2006.01) |
| ***F04D 25/06*** | (2006.01) |

(56) References Cited

U.S. PATENT DOCUMENTS

| | | | | |
|---|---|---|---|---|
| 4,900,228 | A | 2/1990 | Yapp | |
| 4,946,348 | A * | 8/1990 | Yapp | F04D 17/16 415/211.2 |
| 5,110,266 | A * | 5/1992 | Toyoshima | A47L 5/22 415/119 |
| 8,807,930 | B2 | 8/2014 | Green et al. | |
| 2005/0123398 | A1* | 6/2005 | Tam | A47L 5/22 415/211.2 |
| 2008/0014080 | A1* | 1/2008 | Fang | A47L 5/22 415/191 |
| 2014/0158131 | A1 | 6/2014 | Kenyon et al. | |
| 2014/0230184 | A1 | 8/2014 | Danestad et al. | |
| 2016/0032938 | A1* | 2/2016 | Hayamitsu | A47L 5/22 415/199.1 |

FOREIGN PATENT DOCUMENTS

| | | | |
|---|---|---|---|
| JP | 11-125198 | A | 5/1999 |
| JP | 2009-225657 | A | 10/2009 |
| JP | 2010-248940 | A | 11/2010 |
| JP | 2010-281232 | A | 12/2010 |
| JP | 2011-052591 | A | 3/2011 |
| JP | 2011-080427 | A | 4/2011 |
| JP | 2012-255352 | A | 12/2012 |
| JP | 2012-255412 | A | 12/2012 |
| JP | 2012-255413 | A | 12/2012 |
| JP | 2014-001731 | A | 1/2014 |
| JP | 3191384 | U | 6/2014 |
| JP | 2015-034514 | A | 2/2015 |

OTHER PUBLICATIONS

Sawada, T. et al.; "Blower and Vacuum Cleaner"; U.S. Appl. No. 15/576,311, filed Nov. 22, 2017.
Shiozawa, K. et al.; "Blower Apparatus and Vacuum Cleaner"; U.S. Appl. No. 15/527,049, filed May 16, 2017.
Sawada, T. et al.; "Centrifugal Blower and Vacuum Cleaner"; U.S. Appl. No. 15/567,087, filed Oct. 17, 2017.
Hayamitsu, R. et al.; "Blower Device and Vacuum Cleaner"; U.S. Appl. No. 15/577,425, filed Nov. 28, 2017.
Hayamitsu, R. et al.; "Blower and Vacuum Cleaner"; U.S. Appl. No. 15/577,421, filed Nov. 28, 2017.
Hayamitsu, R. et al.; "Blower and Vacuum Cleaner"; U.S. Appl. No. 15/576,338, filed Nov. 22, 2017.

* cited by examiner

BLOWER APPARATUS AND VACUUM CLEANER

BACKGROUND OF THE INVENTION

1. Field of the Invention

The present invention relates to an electric blower apparatus and a vacuum cleaner. The blower apparatus is installed in, for example, a vacuum cleaner.

2. Description of the Related Art

Blower apparatuses installed in vacuum cleaners are required to have a high static pressure. Such blower apparatuses are disclosed in, for example, JP-A 2010-281232 and JP-A 2011-80427. In each of these blower apparatuses, plate-shaped air guides are provided to guide a flow of air downward from a lateral side of an impeller. The air is sucked in through a center of the impeller, and is sent radially outward from the impeller. The air is then guided to a space radially outside of a motor arranged below through the air guides.

Each of the plate-shaped air guides, which are arranged to downwardly guide air sent radially outward from the impeller, includes a curved portion which is inclined to guide the flow of air, but when the impeller rotates at a high speed, a separation of the air may occur at a surface of any air guide to cause noise. A reduction in noise is particularly important when the blower apparatus is used in a consumer product, such as, for example, a vacuum cleaner.

The present invention has been conceived to reduce noise of a blower apparatus while maintaining a high static pressure of the blower apparatus.

SUMMARY OF THE INVENTION

A blower apparatus according to a preferred embodiment of the present invention includes a motor portion having a central axis extending in a vertical direction; an impeller arranged above the motor portion, joined to a rotating portion of the motor portion, and arranged to rotate to send a gas from above radially outward; an impeller cover portion including an inner surface arranged to cover an outer circumference of the impeller and an upper side of an outer edge portion of the impeller, and further including an air inlet defined in a center thereof; a body cover portion joined to the impeller cover portion, arranged to cover an outer circumference of the motor portion, and arranged to define a tubular space between the body cover portion and a housing tubular portion defining an outer surface of the motor portion and extending in the vertical direction to assume a tubular shape; and a plurality of guide vanes arranged in a circumferential direction in the tubular space, and each of which is arranged to extend in a radial direction between an inner surface of the body cover portion and the housing tubular portion. Each of the guide vanes includes a guide vane upper portion arranged on an upper side, and a guide vane lower portion arranged on a lower side of the guide vane upper portion. The guide vane upper portion is inclined to a greater degree with respect to an axial direction than the guide vane lower portion. A lower end of the guide vane is arranged forward of an upper end of the guide vane with respect to a rotation direction of the impeller. The lower end of at least one of the guide vanes is arranged above a lower end of the housing tubular portion.

A blower apparatus according to another preferred embodiment of the present invention includes a motor portion having a central axis extending in a vertical direction; an impeller arranged above the motor portion, joined to a rotating portion of the motor portion, and arranged to rotate to send a gas from above radially outward; an impeller cover portion including an inner surface arranged to cover an outer circumference of the impeller and an upper side of an outer edge portion of the impeller, and further including an air inlet defined in a center thereof; a body cover portion joined to the impeller cover portion, arranged to cover an outer circumference of the motor portion, and arranged to define a tubular space between the body cover portion and a housing tubular portion defining an outer surface of the motor portion and extending in the vertical direction to assume a tubular shape; and a plurality of guide vanes arranged in a circumferential direction in the tubular space, and each of which is arranged to extend in a radial direction between an inner surface of the body cover portion and the housing tubular portion. Each of the guide vanes includes a guide vane upper portion arranged on an upper side, and a guide vane lower portion arranged on a lower side of the guide vane upper portion. The guide vane upper portion is inclined to a greater degree with respect to an axial direction than the guide vane lower portion. A lower end of the guide vane is arranged forward of an upper end of the guide vane with respect to a rotation direction of the impeller. The guide vane is arranged to have a smaller thickness at the upper end of the guide vane than at the guide vane lower portion.

The above preferred embodiment of the present invention is able to reduce noise of the blower apparatus while maintaining a high static pressure of the blower apparatus.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a blower apparatus according to a preferred embodiment of the present invention will be described with reference to the accompanying drawings. It is assumed herein that a direction parallel to a central axis J of a blower apparatus is referred to by the term "axial direction", "axial", or "axially", that directions perpendicular to the central axis J of the blower apparatus are each referred to by the term "radial direction", "radial", or "radially", and that a direction along a circular arc centered on the central axis J of the blower apparatus is referred to by the term "circumferential direction" "circumferential", or "circumferentially". It is also assumed herein that an axial direction is a vertical direction, and that a side on which an impeller is arranged with respect to a motor portion is defined as an upper side. The shape of each member or portion and relative positions of different members or portions will be described based on the above assumptions. It should be noted, however, that the above definitions of the vertical direction and the upper side are not meant to restrict in any way the orientation of a blower apparatus according to any preferred embodiment of the present invention when in use.

Figure 1:
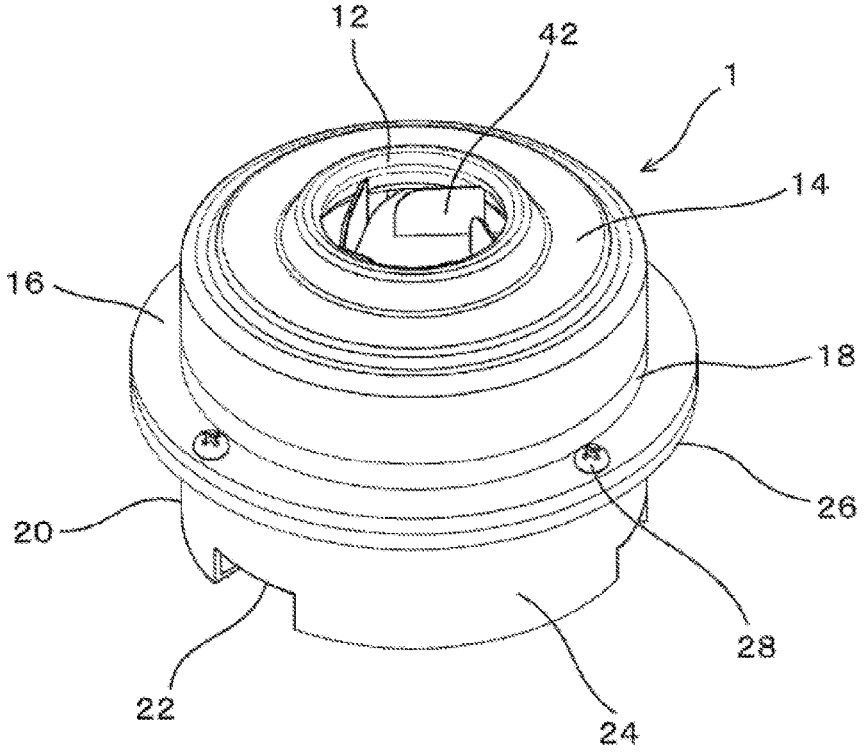
FIG. 1 is a perspective view of a blower apparatus according to a preferred embodiment of the present invention.

FIG. 1 is a perspective view illustrating the overall structure of a blower apparatus 1 according to a preferred embodiment of the present invention. The blower apparatus 1 includes an impeller cover portion 14 and a body cover portion 2 arranged in an outer portion thereof. The impeller cover portion 14 is a member in the shape of a cap, made of a metal, and including an air inlet 12 defined in a central portion of an upper surface thereof. The body cover portion 2 includes an upper cover 18 and a lower cover 20. The upper cover 18 includes a cylindrical portion to which a cylindrical portion of the impeller cover portion 14 is fitted from outside the upper cover 18. An upper flange portion 16 is defined integrally with a lower end of the cylindrical portion of the upper cover 18. The lower cover 20 includes a lower cylindrical portion 24, which includes a plurality of air outlets 22 defined in a lower portion of an outer circumference thereof, and a lower flange portion 26 defined integrally with an upper end of the lower cylindrical portion 24. The lower cover 20 is a resin-molded article. The upper and lower flange portions 16 and 26, which are arranged above and below, respectively, are joined to each other and are fastened through screws 28. The upper and lower covers 18 and 20 are thus joined to each other. More specifically, screw insert holes are defined at several circumferential positions in the upper flange portion 16, while screw holes are defined at several circumferential positions in the lower flange portion 26 such that the screw holes are opposed to the screw insert holes. The screws 28 are screwed into the screw holes through the screw insert holes.

Figure 2:
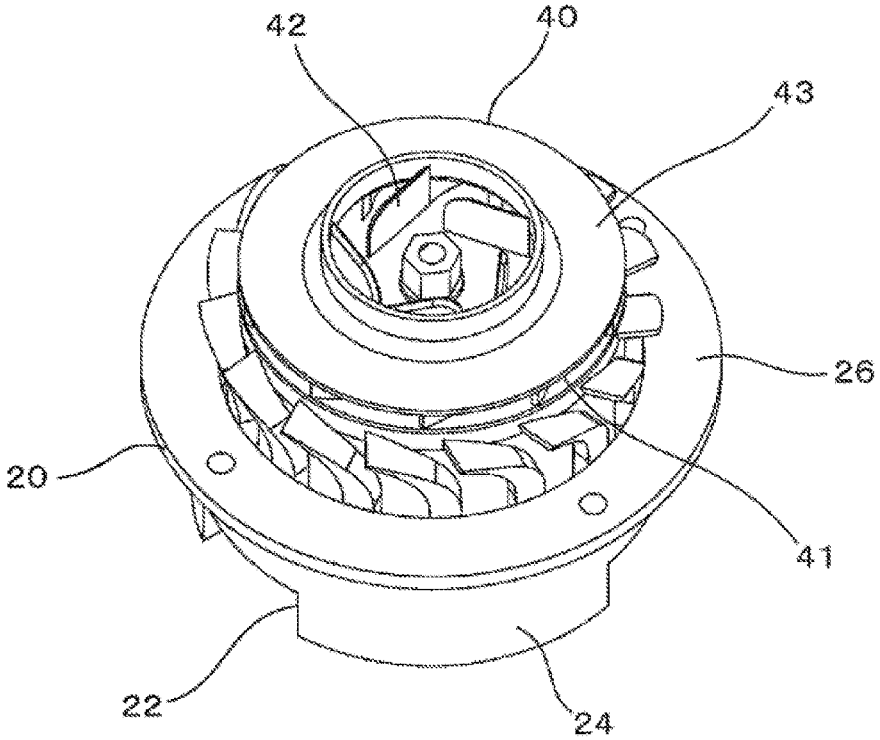
FIG. 2 is a perspective view of the blower apparatus illustrated in FIG. 1 with an upper cover removed therefrom.
Figure 3:
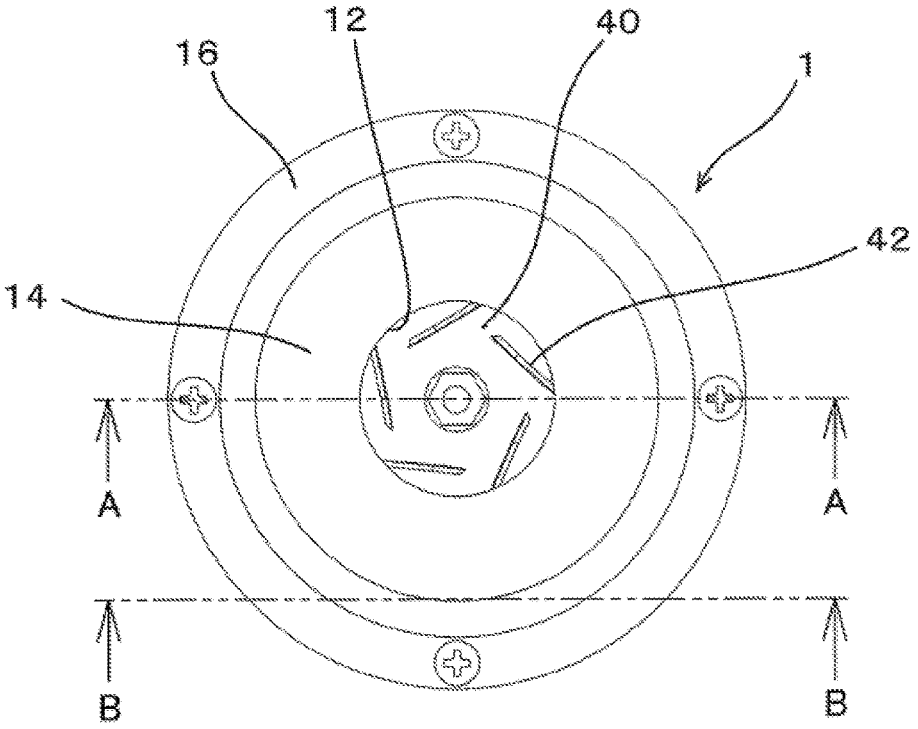
FIG. 3 is a plan view of the blower apparatus illustrated in FIG. 1.
Figure 4:
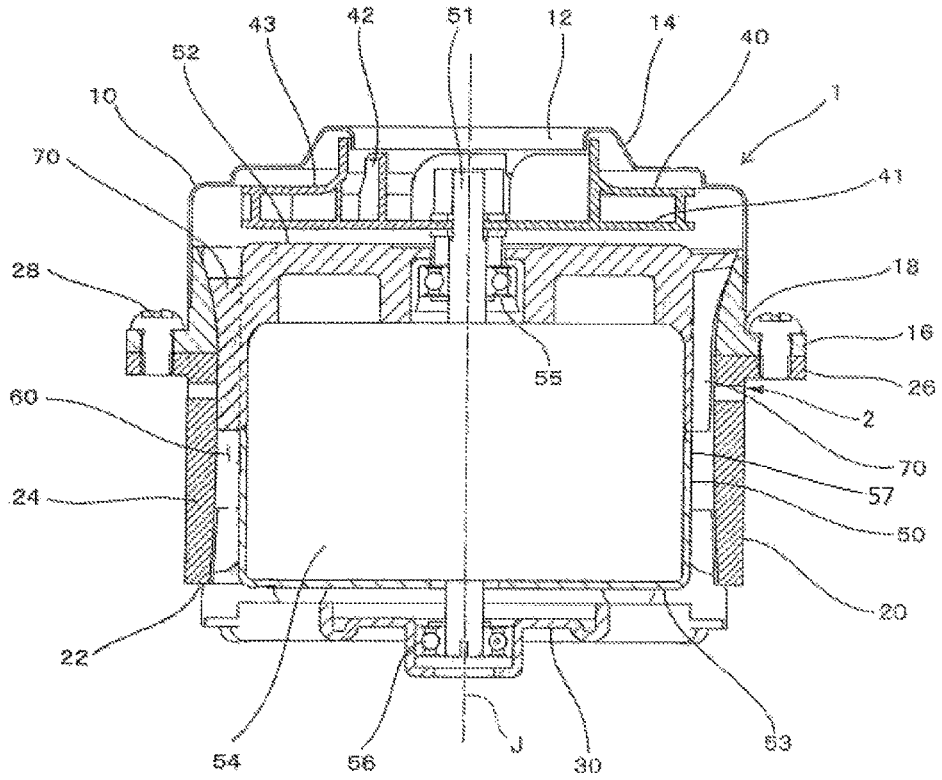
FIG. 4 is a cross-sectional view of the blower apparatus taken along line A-A in FIG. 3.

FIG. 2 is a perspective view of the blower apparatus 1 illustrated in FIG. 1 with the impeller cover portion 14 removed therefrom. FIG. 3 is a plan view of the blower apparatus 1. FIG. 4 is a vertical cross-sectional view of the blower apparatus 1 taken along line A-A, which passes through a center of the blower apparatus 1, in FIG. 3. Parallel oblique lines for details of sections of the blower apparatus 1 may be omitted.

As illustrated in FIG. 4, an interior space of the blower apparatus 1 is defined by the impeller cover portion 14, the body cover portion 2, and a bottom cover 30, which is attached to the body cover portion 2 to cover a lower surface of the body cover portion 2. The blower apparatus 1 further includes an impeller 40, which is defined by a centrifugal impeller, and a motor portion 50, which has a central axis J extending in the vertical direction, in the interior space.

The impeller 40 is covered with the impeller cover portion 14. The impeller cover portion 14 includes a cylindrical outer circumferential portion arranged to cover an outer circumference of the impeller 40, and an upper surface portion arranged to cover an upper side of an outer edge portion of the impeller 40. That is, the impeller cover portion 14 includes an inner surface arranged to cover the outer circumference of the impeller 40 and the upper side of the outer edge portion of the impeller 40. In addition, the impeller cover portion 14 includes the air inlet 12 defined in the central portion of the upper surface thereof. The impeller 40 is arranged above the motor portion 50, is joined to a rotating portion of the motor portion 50, and is arranged to rotate to send a gas from above radially outward. The impeller 40 includes a base plate 41, a plurality of rotor blades 42 arranged in a circumferential direction on an upper surface of the base plate 41, and a shroud 43 in the shape of a curved conical surface, including a central opening, and arranged to join upper ends of the rotor blades 42 to one another. The base plate 41 is in the shape of a circular plate. An upper end portion of a rotating shaft 51 of the motor portion 50 is joined to a central portion of the base plate 41. The impeller 40 is thus attached to the rotating portion of the motor portion 50. The central opening of the shroud 43 of the impeller 40 is arranged to be in communication with the air inlet 12 of the impeller cover portion 14.

The motor portion 50 is, for example, an inner-rotor brushless motor. The motor portion 50 includes a motor housing including an upper housing portion 52, a lower housing portion 53, and a housing tubular portion 57, and motor components 54, which include a rotor portion and a stator portion, accommodated in the motor housing. The rotor portion, which is included in the motor components 54, is supported by the rotating shaft 51, while the rotating shaft 51 is rotatably supported by an upper bearing 55 held on a central portion of the upper housing portion 52 and a lower bearing 56 held on a central portion of the bottom cover 30. Once the motor portion 50 is driven, the rotating shaft 51 is caused to rotate together with the rotor portion, which is included in the motor components 54, so that the impeller 40, which is joined to the rotating shaft 51, is also caused to rotate. Rotation of each of the rotor blades 42 of the impeller 40 pushes air in the vicinity of the rotor blade 42 radially outward, generating negative pressure near a radially inner portion of the rotor blade 42, so that external air is sucked in through the air inlet 12. The impeller 40 is caused by the motor portion 50 to rotate in, for example, a counterclockwise direction in a plan view.

The body cover portion 2 includes the upper and lower covers 18 and 20. In addition, the body cover portion 2, more specifically, the upper cover 18 thereof, is joined to the impeller cover portion 14. The body cover portion 2 is arranged to cover an outer circumferential surface of the motor portion 50. A tubular space 60 is defined between an inner circumferential surface of the body cover portion 2 and the outer circumferential surface of the motor portion 50. That is, the body cover portion 2 is joined to the impeller cover portion 14, and is arranged to cover an outer circumference of the motor portion 50, and define the tubular space 60 between the body cover portion 2 and the housing tubular portion 57, which defines an outer surface of the motor portion 50 and extends in the vertical direction to assume a tubular shape. An upper portion of the tubular space 60 is in communication with a space radially outside of the impeller 40 inside the impeller cover portion 14. Each of the air outlets 22 of the lower cover 20 faces a lower portion of the tubular space 60. An inner circumferential surface of the upper cover 18 is a curved surface whose diameter increases with increasing height. An inner circumferential surface of the lower cover 20 is substantially cylindrical from an upper portion to a middle portion thereof, but is curved at a lower portion thereof, slightly increasing in diameter with decreasing height. As a result, a radial gap in the tubular space 60 is widest at a top thereof, gradually decreases in width toward a middle portion thereof, and then gradually increases in width from the middle portion toward a bottom thereof. Note that a position at which the radial gap in the tubular space 60 is narrow corresponds to, for example, a boundary between a guide vane upper portion 71 and a guide vane lower portion 72 of each of a plurality of guide vanes 70, which will be described below.

The guide vanes 70 are arranged in the circumferential direction in the tubular space 60. In the present preferred embodiment, the guide vanes 70 are arranged at regular intervals. More specifically, the guide vanes 70 are arranged at regular intervals in the circumferential direction in the tubular space 60, and each guide vane 70 is arranged to extend in a radial direction between an inner surface of the body cover portion 2 and the housing tubular portion 57. The guide vanes 70 are integrally molded with the upper housing portion 52. Each of the guide vanes 70 includes the guide vane upper portion 71, which is arranged on the upper side, and the guide vane lower portion 72, which is arranged on the lower side of the guide vane upper portion 71. The guide vane upper portion 71 is inclined to a greater degree with respect to the axial direction than the guide vane lower portion 72. A lower end of each guide vane 70 is arranged forward of an upper end of the guide vane 70 with respect to a rotation direction of the impeller 40. Air discharged by the impeller 40 is thus smoothly guided downward along the guide vane 70. Further, a reduction in noise can be achieved while static pressure of air guided between the guide vanes 70 is maintained. The lower end of each guide vane 70 is arranged forward of the upper end of the guide vane 70 with respect to the rotation direction of the impeller 40. The guide vanes 70 are thus able to guide a wind flowing along the rotation direction of the impeller 40 smoothly axially downward. Further, an improvement in air blowing efficiency of the blower apparatus 1 can be achieved. Note that the circumferential positions of an upper end and a lower end of a radially outer end of each guide vane 70 may be compared with each other to determine which of the upper and lower ends of the guide vane 70 lies forward of the other with respect to the rotation direction. Here, it is preferable that the lower end is arranged forward of the upper end with respect to the rotation direction of the impeller 40. For example, also in a case where the guide vane 70 is inclined with respect to the radial direction when viewed from axially above, and in a case where an upper surface of the guide vane 70 is inclined with respect to a direction perpendicular to the axial direction when viewed in the radial direction, the circumferential positions of the upper and lower ends of the radially outer end of the guide vane 70 may be compared with each other. In addition, a lower end 70*b* of at least one of the guide vanes 70 is arranged above a lower end of the housing tubular portion 57. Thus, when compared to a case where the lower end 70*b* of each guide vane 70 is arranged at a level the same as or lower than that of the lower end of the housing tubular portion 57, channel resistance for air flowing between the guide vanes 70 can be reduced, resulting in improved air blowing efficiency of the blower apparatus 1. In the present preferred embodiment, the axial position of the lower end of the housing tubular portion 57 and the axial position of a lower end of the lower cylindrical portion 24 substantially coincide with each other. That is, the axial position of the lower end of the housing tubular portion 57 substantially coincides with an axial position at which each air outlet 22 is defined. Accordingly, when the lower end 70*b* of each guide vane 70 is arranged at a level higher than that of the lower end of the housing tubular portion 57, the guide vane 70 is not defined in the vicinity of each air outlet 22. This leads to a reduction in pressure of air flowing in the tubular space 60 and a reduction in air resistance in the vicinity of the air outlet 22. Accordingly, an improvement in the air blowing efficiency of the blower apparatus 1 is achieved.

The guide vane upper portion 71 is arranged to curve rearward with respect to the rotation direction with increasing height. That is, rotation of the impeller 40 causes an air current whirling in the same direction as the rotation direction of the impeller 40, and this air current can be smoothly taken in and guided into a downward flow. Thus, the whirling air current sent from the impeller 40 can be guided downward.

Figure 5:
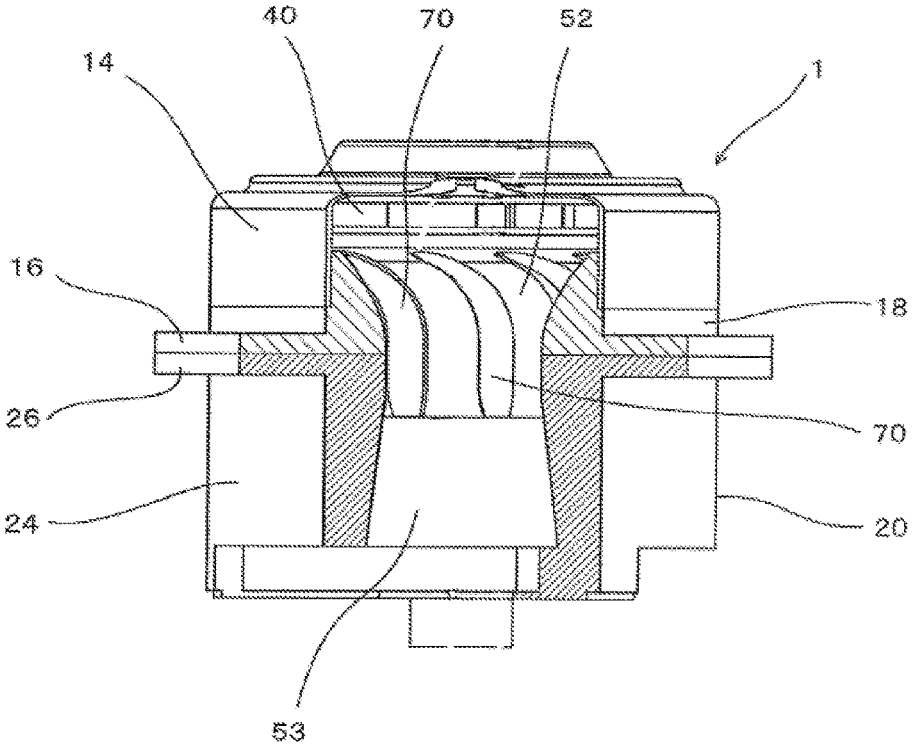
FIG. 5 is a cross-sectional view of the blower apparatus taken along line B-B in FIG. 3.
Figure 6:
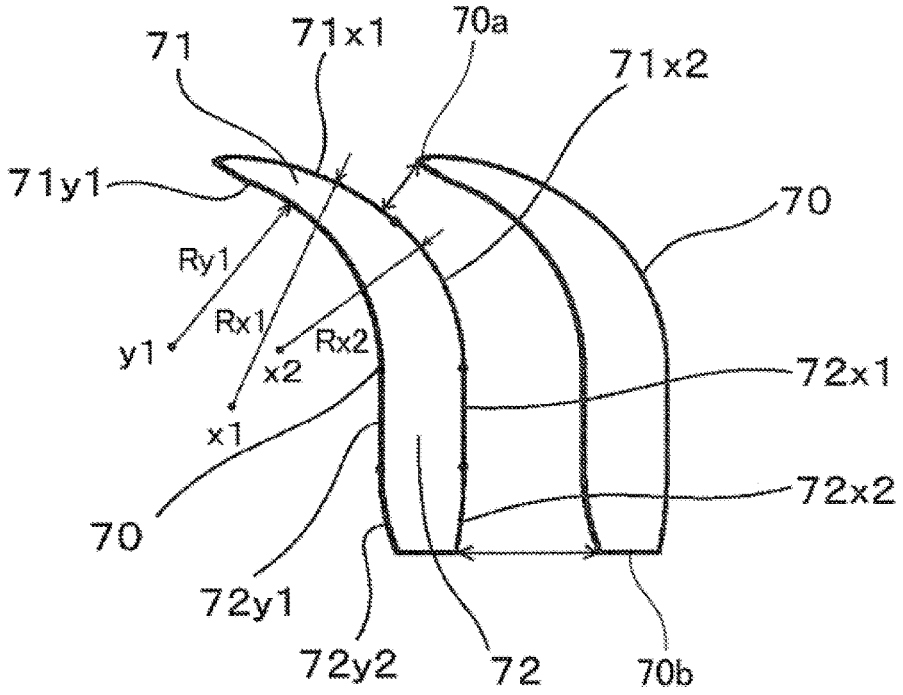
FIG. 6 is a diagram for explaining guide vanes illustrated in FIG. 5 according to a preferred embodiment of the present invention.

FIG. 5 illustrates the blower apparatus 1 when the upper cover 18 and the lower cover 20 are cut along line B-B in FIG. 3. FIG. 6 illustrates two of the guide vanes 70 illustrated in FIG. 5 in an enlarged form. Referring to FIG. 6, a forward surface of the guide vane upper portion 71 with respect to the rotation direction includes a forward upper curved surface 71*x*1 arranged on the upper side, and a forward lower curved surface 71*x*2 arranged on the lower side. On the forward side of the guide vane upper portion 71 of the guide vane 70 with respect to the rotation direction of the impeller 40, the forward upper curved surface 71*x*1 and the forward lower curved surface 71*x*2, which have different radii of curvature, are arranged continuously. The forward upper curved surface 71*x*1 has a radius of curvature Rx1 greater than a radius of curvature Rx2 of the forward lower curved surface 71*x*2 (Rx1>Rx2). This allows air flowing along a forward surface of the guide vane 70 with respect to the rotation direction to smoothly flow along the forward surface of the guide vane 70 with respect to the rotation direction. This leads to improved air blowing efficiency of the blower apparatus 1, resulting in a reduction in noise. Here, a forward upper curved surface center x1 is a center of curvature of the forward upper curved surface 71*x*1, while a forward lower curved surface center x2 is a center of curvature of the forward lower curved surface 71*x*2.

On the rearward side of the guide vane upper portion 71 of the guide vane 70 with respect to the rotation direction of the impeller 40, a curved surface 71*y*1 having a radius of curvature Ry1 smaller than that of the curved surface 71*x*1 is arranged (Rx1>Ry1). That is, a rearward surface of the guide vane upper portion 71 with respect to the rotation direction includes a rearward curved surface 71*y*1 arranged to curve rearward with respect to the rotation direction with increasing height. The radius of curvature Ry1 of the rearward curved surface 71*y*1 is smaller than the radius of curvature Rx1 of the forward upper curved surface 71*x*1. In other words, the forward upper curved surface 71*x*1 is arranged to curve more gently than the rearward curved surface 71*y*1. Thus, the forward upper curved surface 71*x*1 is able to guide air having a forward whirl component with respect to the rotation direction due to the rotation of the impeller 40 while reducing the likelihood of a separation of the air from the guide vane 70. In addition, the rearward curved surface 71*y*1 is able to guide air having a forward whirl component with respect to the rotation direction of a similar magnitude so that the air can smoothly flow downward along the guide vane 70. Here, a rearward curved surface center y1 is a center of curvature of the rearward curved surface 71*y*1.

A center of the forward upper curved surface 71*x*1 is arranged forward of a center of the rearward curved surface 71*y*1 with respect to the rotation direction. That is, when viewed in the radial direction, an axial midpoint of the forward upper curved surface 71*x*1 is arranged forward of an axial midpoint of the rearward curved surface 71*y*1 with respect to the rotation direction. More specifically, each guide vane 70 is arranged to have a circumferential width greater than a half of a circumferential width of an interspace between adjacent ones of the guide vanes 70. Thus, the guide vane 70 has a sufficient circumferential width to allow the forward and rearward curved surfaces of the guide vane 70 with respect to the rotation direction to have more preferable values of curvature. In addition, the guide vane 70 is arranged to have a smaller thickness at a guide vane upper end 70*a* than at the guide vane lower portion 72. Thus, air traveling forward with respect to the rotation direction of the impeller 40 can be smoothly guided from the guide vane upper end 70*a* to the forward upper curved surface 71*x*1. Further, as the air travels downward and the thickness of the guide vane 70 increases, the air is smoothly guided axially downward.

On the forward side with respect to the rotation direction of the impeller 40, the guide vane lower portion 72 of each guide vane 70 includes a forward flat surface 72*x*1 continuous with the curved surface 71*x*2, and, below the forward flat surface 72*x*1, a slanting surface 72*x*2 arranged to slant rearward with respect to the rotation direction with decreasing height. That is, a forward surface of the guide vane lower portion 72 with respect to the rotation direction includes the slanting surface 72*x*2 arranged to slant rearward with respect to the rotation direction with decreasing height. Thus, air which has been guided along the forward surface of the guide vane 70 with respect to the rotation direction is smoothly guided along the slanting surface 72*x*2. Accordingly, the slanting surface 72*x*2 reduces the likelihood that turbulence will occur in the vicinity of the lower end of the guide vane 70 when the air flows downward from the lower end of the guide vane 70. Therefore, the slanting surface 72*x*2 contributes to preventing a reduction in the air blowing efficiency of the blower apparatus 1. In addition, a rearward surface of the guide vane lower portion 72 with respect to the rotation direction includes a rearward flat surface 72*y*1 continuous with the rearward curved surface 71*y*1, and a slanting surface 72*y*2 arranged to slant forward with respect to the rotation direction with decreasing height. Thus, air which has been guided along a rearward surface of the guide vane 70 with respect to the rotation direction is smoothly guided along the slanting surface 72*y*2. Accordingly, the slanting surface 72*y*2 reduces the likelihood that turbulence will occur in the vicinity of the lower end of the guide vane 70 when the air flows downward from the lower end of the guide vane 70. Therefore, the slanting surface 72*y*2 contributes to preventing a reduction in the air blowing efficiency of the blower apparatus 1.

Each of the plurality of guide vanes 70 is arranged to axially overlap in part with an adjacent one of the guide vanes 70. Specifically, as illustrated in FIG. 5, a tip portion of the guide vane upper portion 71 of each guide vane 70 is arranged to axially overlap with the guide vane upper portion 71 and the guide vane lower portion 72 of the guide vane 70 which is adjacent to and rearward of the guide vane 70 with respect to the rotation direction of the impeller 40. The above structure allows the guide vanes 70 to more efficiently take in air sent from the impeller 40 and guide the air into the downward flow.

An intervane space between every adjacent ones of the plurality of guide vanes 70, which are arranged at regular intervals in the circumferential direction in the tubular space 60, is arranged to be narrowest at a tip of the guide vane upper portion 71 of the guide vane 70 and widest at a lower end of the guide vane lower portion 72 of the guide vane 70 when measured in a direction perpendicular to a direction in which the gas flows through the air channel between the adjacent guide vanes 70.

Once the motor portion 50 is driven in the blower apparatus 1 having the above-described structure, the impeller 40 is caused to rotate to take in external air through the air inlet 12 of the impeller cover portion 14 and discharge the air radially outward as a swirl flow, so that the air is guided to an inner surface of the cylindrical outer circumferential portion of the impeller cover portion 14. Further, the air current sent from the impeller 40 is guided into the tubular space 60 to pass through the intervane space between the adjacent guide vanes 70, so that the swirl flow is guided into an axial flow.

At this time, each guide vane 70 is able to effectively take the swirl flow from the impeller 40 into the interspace between the guide vanes 70 through the guide vane upper portion 71 arranged in the upper portion thereof. In addition, the thickness of the guide vane upper portion 71 varies along the direction in which the air flows. Specifically, the forward upper curved surface 71*x*1 and the forward lower curved surface 71*x*2, which have different radii of curvature, are arranged on the forward side of the guide vane 70 with respect to the rotation direction, and the one rearward curved surface 71*y*1 is arranged on the rearward side of the guide vane upper portion 71 with respect to the rotation direction, and this enables the air current to be efficiently guided along the surface of the guide vane 70 without a separation of the air current. In particular, it has been observed that, when the radii of curvature Rx1 and Rx2 of the forward upper curved surface 71*x*1 and the forward lower curved surface 71*x*2, respectively, on the forward side of the guide vane upper portion 71 with respect to the rotation direction meet the relationship Rx1>Rx2, and the radius of curvature Ry1 of the rearward curved surface 71*y*1 on the rearward side of the guide vane upper portion 71 with respect to the rotation direction meets the relationship Rx1>Ry1, the air flow in the tubular space 60 is improved to achieve a significant improvement in efficiency.

In addition, the radial gap in the tubular space 60 is narrowest near the boundary between the guide vane upper portion 71 and the guide vane lower portion 72 of each guide vane 70. More specifically, in the tubular space 60, the radial gap between the outer surface of the motor portion 50 and the inner surface of the body cover portion 2 is arranged to continuously decrease in width from the axially upper side toward an axial middle portion thereof, and continuously increase in width from the axial middle portion toward the axially lower side. Thus, air which has flowed into the tubular space 60 is compressed in the vicinity of the boundary between the guide vane upper portion 71 and the guide vane lower portion 72 due to an increase in channel resistance, and the air is thereafter decompressed to form a gentle air flow due to a gradual increase in the width of the radial gap as the air travels downward along the guide vane lower portion 72. The air is thus discharged with a reduced likelihood of a separation of the air. In particular, the above effect is promoted by a gradual increase in the width of the interspace between the adjacent guide vanes 70 at a lower portion of the guide vane lower portion 72.

While a preferred embodiment of the present invention has been described above, it will be understood that the present invention is not limited to the above-described preferred embodiment, and that a variety of modifications are possible without departing from the scope of the present invention as claimed below.

Figure 7:
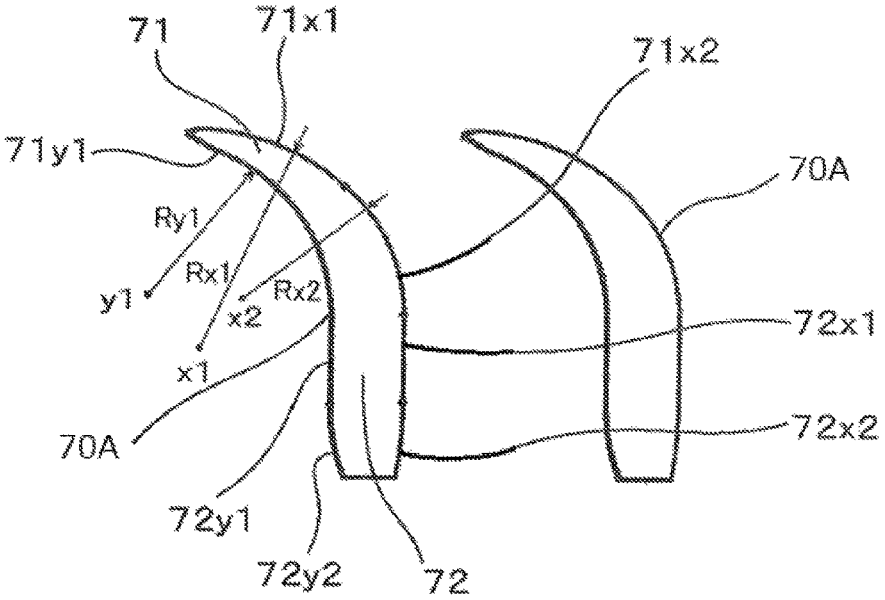
FIG. 7 is a diagram illustrating guide vanes according to a preferred modification of the above preferred embodiment of the present invention.

FIG. 7 is a diagram illustrating guide vanes 70A according to a preferred modification of the present preferred embodiment. The same reference characters as used for portions of the guide vanes 70 illustrated in FIG. 6 will be used for portions of the guide vanes 70A illustrated in FIG. 7. In FIG. 6, each of the guide vanes 70 arranged in the tubular space 60 is arranged to axially overlap in part with an adjacent one of the guide vanes 70. Note, however, that each of the guide vanes 70 may not necessarily be arranged to axially overlap with the adjacent one of the guide vanes 70. The guide vanes 70A illustrated in FIG. 7 are not arranged to axially overlap with each other. Accordingly, the guide vanes 70A can be molded using molds which are slid in the vertical direction. That is, resin-molding molds having a simple structure can be used to mold the guide vanes 70A. That is, a forward end portion of each guide vane 70A with respect to the rotation direction is preferably arranged rearward of a rearward end portion of a forwardly adjacent one of the guide vanes 70A with respect to the rotation direction. Thus, the adjacent ones of the guide vanes 70A are arranged not to axially overlap with each other. Accordingly, the guide vanes 70A can be molded using molds which are slid in the vertical direction. Therefore, the guide vanes 70A can be molded using simple molds, which leads to an improved mass productivity of the blower apparatus 1.

Meanwhile, in the case where the guide vanes 70 are arranged to axially overlap in part with one another as illustrated in FIG. 6, it may be so arranged that alternate ones of the guide vanes 70 are integrally defined with the upper housing portion 52 while the other alternate ones of the guide vanes 70 are integrally defined with the upper cover 18.

Further, although, in the above-described preferred embodiment, the guide vane lower portion 72 of each of the plurality of guide vanes 70 arranged in the tubular space 60 is arranged to extend axially downward, this is not essential to the present invention. The guide vane lower portion 72 may be arranged to extend downward and be angled with respect to the axial direction toward the direction in which the guide vane upper portion 71 is curved. When each guide vane 70 is shaped in such a manner, an effect similar to the effect of the above-described preferred embodiment can be obtained even if the length of the guide vane upper portion 71 is reduced, and therefore, the length of each guide vane 70 can be reduced to achieve a reduction in the size of the blower apparatus 1 as a whole.

Although, in the above-described preferred embodiment, the impeller 40 caused by the motor portion 50 to rotate is a centrifugal impeller, this is not essential to the present invention. A mixed flow impeller may alternatively be used. In this case, the mixed flow impeller is joined to the rotating portion of the motor portion, and is caused by the motor portion to rotate to suck a gas from above and send the gas radially outward while guiding the gas along slanting surfaces of the mixed flow impeller.

Figure 8:
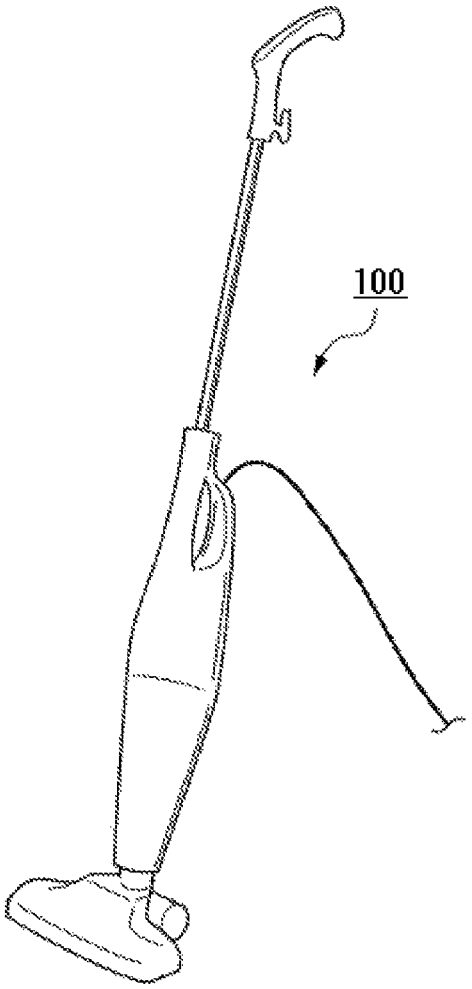
FIG. 8 is a perspective view of a vacuum cleaner including the blower apparatus.

FIG. 8 is a perspective view of a vacuum cleaner 100. The vacuum cleaner 100 includes the blower apparatus 1 according to the present preferred embodiment. Thus, the vacuum cleaner 100 is able to achieve reduced noise while maintaining a static pressure of air flowing in the vacuum cleaner 100.

Although the blower apparatus according to the above-described preferred embodiment of the present invention is used in a vacuum cleaner which utilizes air sucked by the blower apparatus, this is not essential to the present invention. A blower apparatus according to a preferred embodiment of the present invention may be used in, for example, a hair drier which utilizes air sent out by the blower apparatus.

Blower apparatuses according to preferred embodiments of the present invention are suitable for use in, for example, electric vacuum cleaners, hair driers, and the like.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A blower apparatus comprising:

a motor portion having a central axis extending in a vertical direction;

an impeller arranged above the motor portion, joined to a rotating portion of the motor portion, and arranged to rotate to send a gas from above to radially outward;

an impeller cover portion including an inner surface arranged to cover an outer circumference of the impeller and an upper side of an outer edge portion of the impeller, and further including an air inlet defined in a center thereof;

a body cover portion joined to the impeller cover portion, arranged to cover an outer circumference of the motor portion, and arranged to define a tubular space between the body cover portion and a housing tubular portion defining an outer surface of the motor portion and extending in the vertical direction to assume a tubular shape; and a plurality of guide vanes arranged in a circumferential direction in the tubular space, and each of which is arranged to extend in a radial direction between an inner surface of the body cover portion and the housing tubular portion; wherein each of the guide vanes includes a guide vane upper portion arranged on an upper side, and a guide vane lower portion arranged on a lower side of the guide vane upper portion;

the guide vane upper portion is inclined to a greater degree with respect to an axial direction than the guide vane lower portion;

a lower end of the guide vane is arranged forward of an upper end of the guide vane with respect to a rotation direction of the impeller; and the lower end of at least one of the guide vanes is arranged above a lower end of the housing tubular portion.

2. The blower apparatus according to claim 1, wherein a forward end portion of each guide vane with respect to the rotation direction is arranged rearward of a rearward end portion of a forwardly adjacent one of the guide vanes with respect to the rotation direction.

3. The blower apparatus according to claim 2, wherein the guide vane upper portion is arranged to curve rearward with respect to the rotation direction with increasing height.

4. The blower apparatus according to claim 1, wherein a forward surface of the guide vane upper portion with respect to the rotation direction includes a forward upper curved surface arranged on the upper side, and a forward lower curved surface arranged on the lower side; and the forward upper curved surface is arranged to have a radius of curvature greater than a radius of curvature of the forward lower curved surface.

5. The blower apparatus according to claim 4, wherein a rearward surface of the guide vane upper portion with respect to the rotation direction includes a rearward curved surface arranged to curve rearward with respect to the rotation direction with increasing height; and the rearward curved surface is arranged to have a radius of curvature smaller than the radius of curvature of the forward upper curved surface.

6. The blower apparatus according to claim 1, wherein, in the tubular space, a radial gap between the outer surface of the motor portion and the inner surface of the body cover portion is arranged to continuously decrease in width from an axially upper side toward an axial middle portion thereof, and continuously increase in width from the axial middle portion toward an axially lower side.

7. The blower apparatus according to claim 1, wherein a rearward surface of the guide vane lower portion with respect to the rotation direction includes a slanting surface arranged to slant forward with respect to the rotation direction with decreasing height.

8. The blower apparatus according to claim 1, wherein a forward surface of the guide vane lower portion with respect to the rotation direction includes a slanting surface arranged to slant rearward with respect to the rotation direction with decreasing height.

9. A vacuum cleaner comprising the blower apparatus of claim 1.

10. A blower apparatus comprising:

a motor portion having a central axis extending in a vertical direction;

an impeller arranged above the motor portion, joined to a rotating portion of the motor portion, and arranged to rotate to send a gas from above radially outward;

an impeller cover portion including an inner surface arranged to cover an outer circumference of the impeller and an upper side of an outer edge portion of the impeller, and further including an air inlet defined in a center thereof;

a body cover portion joined to the impeller cover portion, arranged to cover an outer circumference of the motor portion, and arranged to define a tubular space between the body cover portion and a housing tubular portion defining an outer surface of the motor portion and extending in the vertical direction to assume a tubular shape; and a plurality of guide vanes arranged in a circumferential direction in the tubular space, and each of which is arranged to extend in a radial direction between an inner surface of the body cover portion and the housing tubular portion; wherein each of the guide vanes includes a guide vane upper portion arranged on an upper side, and a guide vane lower portion arranged on a lower side of the guide vane upper portion;

the guide vane upper portion is inclined to a greater degree with respect to an axial direction than the guide vane lower portion;

a lower end of the guide vane is arranged forward of an upper end of the guide vane with respect to a rotation direction of the impeller; and the guide vane is arranged to have a smaller thickness at the upper end of the guide vane than at the guide vane lower portion.

11. The blower apparatus according to claim 10, wherein a forward end portion of each guide vane with respect to the rotation direction is arranged rearward of a rearward end portion of a forwardly adjacent one of the guide vanes with respect to the rotation direction.

12. The blower apparatus according to claim 11, wherein the guide vane upper portion is arranged to curve rearward with respect to the rotation direction with increasing height.

13. The blower apparatus according to claim 10, wherein a forward surface of the guide vane upper portion with respect to the rotation direction includes a forward upper curved surface arranged on the upper side, and a forward lower curved surface arranged on the lower side; and the forward upper curved surface is arranged to have a radius of curvature greater than a radius of curvature of the forward lower curved surface.

14. The blower apparatus according to claim 13, wherein a rearward surface of the guide vane upper portion with respect to the rotation direction includes a rearward curved surface arranged to curve rearward with respect to the rotation direction with increasing height; and the rearward curved surface is arranged to have a radius of curvature smaller than the radius of curvature of the forward upper curved surface.

15. The blower apparatus according to claim 10, wherein, in the tubular space, a radial gap between the outer surface of the motor portion and the inner surface of the body cover portion is arranged to continuously decrease in width from an axially upper side toward an axial middle portion thereof, and continuously increase in width from the axial middle portion toward an axially lower side.

16. The blower apparatus according to claim 10, wherein a rearward surface of the guide vane lower portion with respect to the rotation direction includes a slanting surface arranged to slant forward with respect to the rotation direction with decreasing height.

17. The blower apparatus according to claim 10, wherein a forward surface of the guide vane lower portion with respect to the rotation direction includes a slanting surface arranged to slant rearward with respect to the rotation direction with decreasing height.

18. A vacuum cleaner comprising the blower apparatus of claim 10.

* * * * *